US009511885B2

(12) United States Patent
Stuhlmann

(10) Patent No.: US 9,511,885 B2
(45) Date of Patent: Dec. 6, 2016

(54) CLUSTER PACK AND METHOD FOR FORMING CLUSTER PACKS

(71) Applicant: KHS GmbH, Dortmund (DE)

(72) Inventor: Christopher Stuhlmann, Korbach (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 14/422,767

(22) PCT Filed: Aug. 1, 2013

(86) PCT No.: PCT/EP2013/002283

§ 371 (c)(1),
(2) Date: Feb. 20, 2015

(87) PCT Pub. No.: WO2014/029462

PCT Pub. Date: Feb. 27, 2014

(65) Prior Publication Data

US 2015/0217885 A1 Aug. 6, 2015

(30) Foreign Application Priority Data

Aug. 20, 2012 (DE) ..... 10 2012 016 340

(51) Int. Cl.

| | |
|---|---|
| ***B65B 11/00*** | (2006.01) |
| ***B65B 11/58*** | (2006.01) |
| ***B65B 21/24*** | (2006.01) |
| ***B65B 21/26*** | (2006.01) |
| ***B65B 27/04*** | (2006.01) |
| ***B65D 71/50*** | (2006.01) |
| ***B65B 51/02*** | (2006.01) |
| ***B65B 53/00*** | (2006.01) |
| ***B65D 65/14*** | (2006.01) |

(Continued)

(52) U.S. Cl.

CPC ..... *B65B 11/00* (2013.01); *B65B 11/58* (2013.01); *B65B 21/24* (2013.01); *B65B 21/26* (2013.01); *B65B 27/04* (2013.01); *B65B 51/02* (2013.01); *B65B 53/00* (2013.01); *B65D 65/14* (2013.01); *B65D 71/506* (2013.01); *B65D 75/004* (2013.01); *B65D 75/5827* (2013.01); *Y10T 156/10* (2015.01)

(58) Field of Classification Search

CPC ..... B65D 71/08; B65D 71/10; B65D 75/002; B65D 75/004; B65D 75/006; B65D 75/5827

USPC ..... 206/150, 432, 497

See application file for complete search history.

(56) References Cited

U.S. PATENT DOCUMENTS 3,084,792 A * 4/1963 Poupitch ..... B65D 71/504 206/150
4,828,110 A * 5/1989 Lems ..... B65D 71/02 206/150

(Continued)

FOREIGN PATENT DOCUMENTS

DE 20 19 948 11/1971
DE 23 31 193 1/1975

(Continued)

*Primary Examiner* — Bryon Gehman

(74) *Attorney, Agent, or Firm* — Occhiuti & Rohlicek LLP

(57) ABSTRACT

A method for making cluster packs includes receiving one or more container streams, grouping containers into a container cluster, before applying a shrink film, arranging a band around the container cluster, and applying adhesive material to end faces of the container cluster.

13 Claims, 3 Drawing Sheets

(51) Int. Cl.
*B65D 75/00* (2006.01)
*B65D 75/58* (2006.01)

(56) References Cited

U.S. PATENT DOCUMENTS

| | | | | |
|---|---|---|---|---|
| 4,932,528 | A * | 6/1990 | Benno | B65D 71/10 206/432 |
| 6,223,499 | B1 * | 5/2001 | Wilkey | B65D 71/08 53/399 |
| 7,726,464 | B2 | 6/2010 | Cerf | |
| 7,832,553 | B2 * | 11/2010 | Hartness | B65D 71/08 206/150 |
| 7,850,003 | B2 * | 12/2010 | Hartness | B65D 71/08 206/150 |
| 8,333,054 | B2 * | 12/2012 | Hartl | B65D 71/08 206/432 |
| 2011/0005955 | A1 * | 1/2011 | Laupie | B65D 71/08 206/427 |

FOREIGN PATENT DOCUMENTS

| | | |
|---|---|---|
| DE | 41 26 212 | 2/1993 |
| DE | 10 2006 037105 | 2/2008 |
| DE | 10 2008 059 376 | 10/2009 |
| DE | 10 2009 025824 | 11/2010 |
| DE | 10 2009 044271 | 4/2011 |
| EP | 2 096 039 | 9/2009 |
| WO | WO01/74668 | 10/2001 |
| WO | WO2013/104534 | 7/2013 |

* cited by examiner

CLUSTER PACK AND METHOD FOR FORMING CLUSTER PACKS

RELATED APPLICATIONS

This application is the national stage, under 35 USC 371, of international application PCT/EP2013/002283, filed on Aug. 1, 2013, which claims the benefit of the Aug. 20, 2012 priority date of German application DE 102012016340.1, the content of which is herein incorporated by reference.

FIELD OF INVENTION

The invention relates to product packaging, and in particular, to cluster packs.

BACKGROUND

Known methods of making a cluster pack begin with a wide stream of randomly-oriented containers standing on a transport plane of a transporter with their container axes oriented vertically. Lane dividers then convert the wide container stream into single-track container streams. In further method steps, the containers that are to be formed into a cluster pack are divided off from the single-lane container streams. The required number of containers is combined to form a consolidated container group in which the containers bear against one another by a plurality of circumferential surfaces, or contact surfaces. The containers of each container group are then bound to form a compact and stable cluster pack.

A number of ways are known for binding the containers together. One way is to use shrink films. Another way is to encompass the containers with a band.

One disadvantage of using bands is that, when a container is first removed from a banded cluster pack, the band can no longer securely hold the remaining containers. This is true even if the band is never cut. Even without cutting the band, removing a container will disrupt the integrity of the cluster pack.

Another problem that arises is that when such cluster packs are being transported, vibrations or mechanical disturbances can cause cylindrical articles, such as cans, bottles or containers, to slide into the gap in the neighboring row. This behavior, which is often called "nesting," can be prevented by maintaining the bands under very high tension.

Another known method for making a cluster pack uses a rotary star on both sides of a track to press bottle necks into clamps on flat carriers. A band or covering can then encircle the cluster pack.

It is also known to apply adhesive to containers in narrow areas or rows. Adjacent areas, which are not provided with adhesive, then allow the pack to be gripped for carrying. In these cluster packs, containers stick to one another at the adhesive sites. Also known is providing containers with an adhesive and arranging a shrink film around the containers.

In the case of tall, long containers, a large overlapping length of film is required to reasonably fill a shrink gap. This leads to a high material consumption and thus to considerable film costs. Additionally, long film ends at the sides laminate very poorly to one another. In a shrink tunnel, they shrink unevenly. This results in a wrinkly appearance. Such an appearance can create an impression of substandard quality and thus diminish sales.

The containers of a cluster pack usually have a container code, such as a barcode or a QR code, that can be read by a suitable reader. The container code contains information for the retailer. It is useful for each container to have such a code so that individual containers can be removed from the cluster pack and sold one at a time.

In some cases, one may wish to sell the cluster as a whole. In that case it is useful to have a cluster code on the shrink film that is arranged around the cluster pack so that a code-reader can detect the price of the cluster pack.

A problem that can arise when there is both a cluster code and a container code is that the reader may read the wrong code. Instead of reading the code for the cluster pack, the reader ends up reading the code for a container. This can result in a cluster pack being sold for the price of a container. Although this may be a boon for a consumer, it is a considerable disadvantage for the retailer.

SUMMARY

An object of the invention is to provide a cluster pack that avoids the aforesaid disadvantages, and a method for making such a cluster pack. The cluster pack reduces consumption of shrink film and avoids wrinkling. Additionally, when a complete cluster pack is provided to a reader, the reader will read the cluster pack code and avoid reading an individual container code.

In one aspect, the invention features a method for producing cluster packs in which, before the application of a shrink film, a band is arranged on a container cluster and shrink film is bonded at least on areas of the end faces. A lateral area of the cluster pack face on which a shrink film hole is also arranged is to be understood as an end face.

It is not crucial for the areas of the application of adhesive or glue to be defined so clearly. It is crucial that the film maintain sufficient area for shrinking and the movement that accompanies it. At the same time, in the area of the free film ends, movement during shrinking is slowed down or halted.

In some embodiments, the dimensions of the band and the manner of its placement around the container cluster are such that the band covers at least one code arranged on the containers of the container cluster. Examples of a covered code include a bar code and a QR code. In a preferred embodiment, the band is arranged around a belly area of each of the containers of the container cluster.

To hold the band in a stable position, it is advantageous to arrange it in a form-fitting manner around the containers. In this way, the band can reach around the containers of the cluster pack under tension. The tension force only needs to be enough so that the band does not slip in the further processing of the subsequent cluster pack.

It is possible for the band to be supplied on the subsequent cluster pack as strips. In such a case, the strip ends are bonded to each other so that adjacent strips overlap with each other. The strip ends can also be glued to each other.

In a further preferred embodiment, the band is secured at least on the corner containers of the container cluster. This can be achieved, for example, by providing adhesive or glue on the corner containers.

Once the band is arranged around the cluster pack, the shrink film is arranged around and encloses the cluster pack and the band. The container cluster, which is now wrapped, is then fed to a shrink device. The shrink device shrinks the shrink film, transforming the container cluster into a cluster pack.

In one practice, the shrink film is glued to the band on the end faces of the cluster pack. If there is no band, the shrink film is glued to the corner containers of the cluster pack in each case on the end faces of the cluster pack.

Gluing the shrink film to the end faces of the cluster pack holds the shrink film in a stable position that remains stable even during the subsequent shrink operation. This avoids the need for a large overlapping film length and thus avoids wrinkling on the end faces.

In some embodiments, the cluster pack has a carrying element. The carrying element can be a plastic carrying strip that is secured to the cluster pack.

In another aspect, the invention features a cluster pack that has a band between the shrink film and the containers of the cluster pack. The film is secured to the end faces of the cluster pack. The band covers at least the codes of the individual containers. This avoids having a reader accidentally read the individual container codes.

In some embodiments, the band itself bears a code that can hold data about the cluster pack. Thus, for example, price information for the entire cluster pack can be read from this code.

In some embodiments, the band is printed upon. The band can be made of card stock, thin pasteboard or paper, or a pasteboard/paper combination. The band can be printed upon with more than just a code, and can carry other kinds of information to the extent that the shrink film is transparent.

The cluster pack is film-free or open at least in areas on the end faces as the film ends neither overlap nor touch each other. In some embodiments, the band has tear points in this area so that the band can be torn particularly easily. This makes removal of the shrink film easier.

In some embodiments, the tear points are made as notch-type recesses on the edges of the band that are oriented towards each other by their arrow-like notch base so that a preferred tear is immediately recognizable. In some embodiments, perforations between the notch bases weaken the band and make it easier to tear.

In one aspect, the invention features a method for making cluster packs, the method including receiving one or more container streams, grouping containers from the one or more container streams into a container cluster, before applying a shrink film, arranging a band around the container cluster, and applying adhesive material to end faces of the container cluster. The adhesive material is glue or adhesive.

In some practices, the method further includes gluing the shrink film to the band in the end faces.

Other practices include those in which arranging a band around a container cluster includes arranging the band around a belly area of the containers in the container cluster, and those in which arranging a band around a container cluster includes arranging the band in a form-fitting manner on the container cluster.

Other practices include feeding a strip of sequential bands for arrangement around container clusters In the strip, sequential bands have ends that are connected to ends of adjacent bands, and that overlap ends of adjacent bands.

Some practices include securing the band to corner containers of the container cluster. Among these are practices in which securing the band includes applying adhesive material to the corner containers.

Other practices include applying shrink film around the container cluster and the band, and feeding the container cluster, shrink film, and band together into a shrink device for shrinking the shrink film onto the container cluster. Among these are practices in which, prior to feeding the container cluster, shrink film, and band together into the shrink device, the shrink film is glued onto end faces of the container cluster.

Other practices include fitting the container cluster with a carrying element.

In another aspect, the invention features a cluster pack that includes containers, shrink film, and a band. The band is arranged between the shrink film and the containers. The shrink film is glued to end faces of the cluster pack by application of adhesive material.

In some embodiments, the shrink film is glued on the band.

In other embodiments, the band includes a designated tear point on at least one end face of the cluster pack.

In another aspect, the invention features a method for making cluster packs. Such a method includes receiving one or more container streams, grouping containers into a container cluster, before applying a shrink film, arranging a band around the container cluster, and applying adhesive material to end faces of the container cluster.

As used herein, containers include PET bottles, bottles, cans, tubes, and pouches, whether made of metal, glass and/or plastic. Containers also include other packaging means, in particular those suitable for filling with liquid or viscous products, as well as those already combined into groups, or multi-packs. The containers of a cluster pack are arranged in a non-nesting position.

Certain containers, such as PET bottles, have a contact area that is spherically domed so that the containers can effectively roll against each other around a circumferential track, or a "rolling ring." With glass bottles, particularly reusable glass bottles, the rolling ring can be recognized by its lighter color. With PET bottles, "rolling rings" of this kind can be arranged not only in the top area but also in the base area.

As used herein, "bonding or adhesive agents" refers to all materials or masses with which an adhesive bond between the components of a cluster pack is possible.

BRIEF DESCRIPTION OF THE DRAWINGS

These and other advantages of the invention will be apparent from the following detailed description and the accompanying figures, in which.

In the various figures, the same parts are always given the same reference numbers, and hence they are generally also only described once.

DETAILED DESCRIPTION

Figure 1:
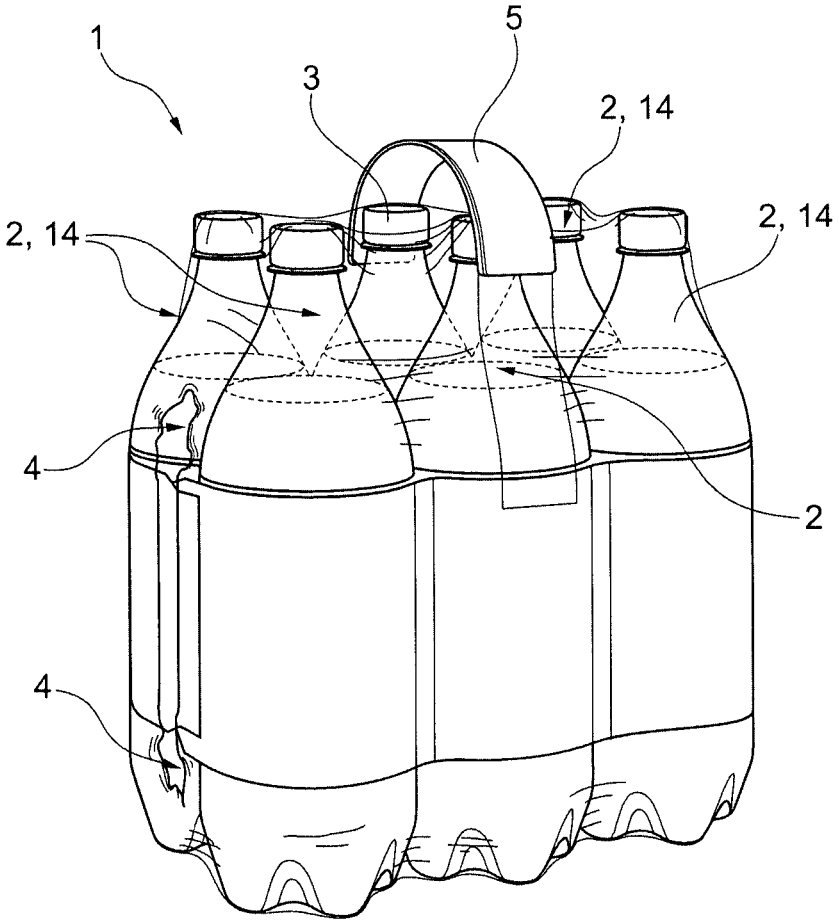
FIG. 1 is a perspective view of a cluster pack.

FIG. 1 shows a cluster pack 1 having six containers 2 encased by a shrink film 3. A carrying strip 5 glued to the outside of the shrink film 3 enables the cluster pack 1 to be carried. On the end faces of the cluster pack, the shrink film 3 is shrunk unevenly, particularly around shrink holes 4.

Figure 2:
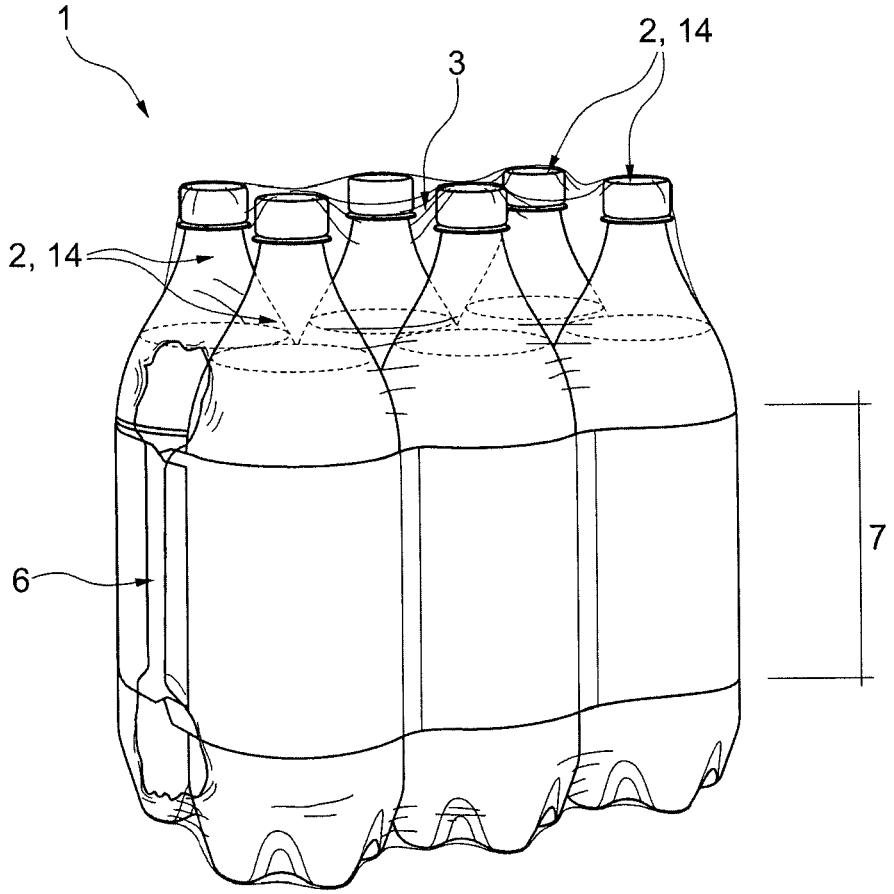
FIG. 2 is a perspective view of an improved cluster pack.
Figure 3:
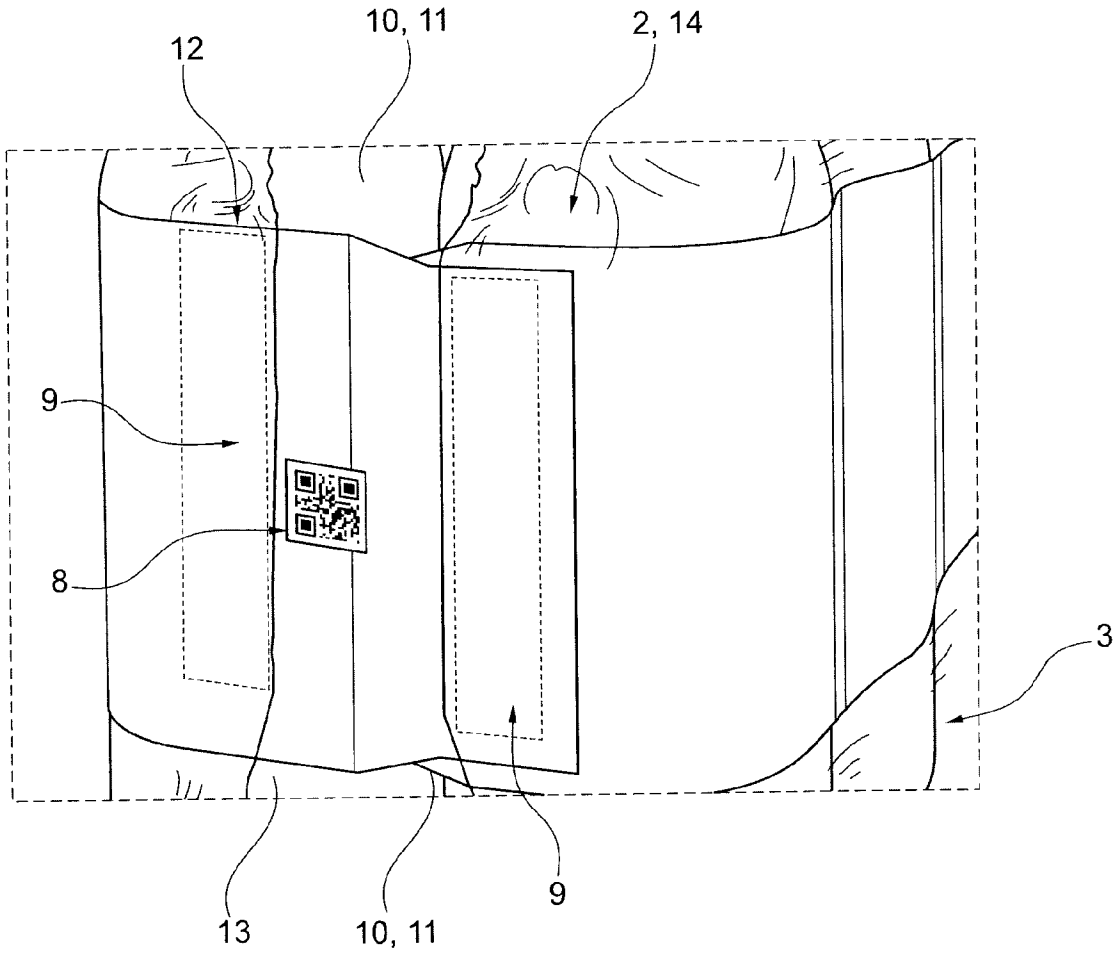
FIG. 3 is a close-up view of a face area of the cluster pack from FIG. 2.

FIG. 2 shows another cluster pack 1, this time having a band 6 arranged around belly areas 7 of the containers 2 of the cluster pack 1. The band 6 can be printed upon. In particular, as seen in FIG. 3, a code 8 can be printed on the end faces. Examples of a code 8 include a bar code and a QR code. Information from any other source can also be printed upon the band 6.

In the illustrated example, film ends 9 of the shrink film 3 are glued on the band 6 on the end faces. Moreover, a narrow vertical adhesive strip in the end face area is omitted.

On the end faces, the cluster pack 1 is film-free as far as possible. In addition, the film ends 9 do not overlap and, in fact, do not even touch each other.

In FIG. 3, a tear point 10 can also be seen in the film-free end face area. The tear point 10 is arranged on the band 6 on the end faces and is easily visible to the consumer through a notch 11 on the top and bottom edges 12. A perforation or any other material weakness in the band 6 can be provided between the arrow-like notches 11.

In some embodiments, the containers 2 of the cluster pack 1 are bonded to each other at contact or touching areas. This bond can be achieved by using glue or adhesive. Corresponding coating stations can be provided to apply the necessary glue and adhesive.

In some embodiments, the containers 2 in the cluster pack 1 are oriented identically so that an application of adhesive or glue on the corresponding end face area of the relevant particular corner container 14 is possible. The shrink film is glued to this corner. A corresponding adhesive tape can also be provided to bond the shrink film ends 9 to the corner containers 14. Adhesive or glue can also be applied to the band 6 to bond the shrink film ends 9 to the band 6 on the end faces. As an alternative, an adhesive tape can also be used.

Having described the invention, and a preferred embodiment thereof, what is claimed as new, and secured by Letters Patent is:

1. A method for making a cluster pack that comprises containers, shrink film, and a band, wherein said band and said shrink film encircle all of said containers, wherein said band is arranged between said shrink film and said containers, and wherein said shrink film is adhered to end faces of said cluster pack by application of adhesive material, said method comprising receiving one or more container streams, grouping containers from said one or more container streams into a container cluster, before applying a shrink film, arranging a band around said container cluster such that said band encloses all of said containers, causing said shrink film to encircle all of said containers, thereby causing said band to be arranged between said shrink film and said containers, and applying adhesive material to end faces of said container cluster, wherein said adhesive material is selected from the group consisting of glue and adhesive.

2. The method of claim 1, further comprising gluing said shrink film to said band in said end faces.

3. The method of claim 1, wherein arranging a band around a container cluster comprises arranging said band around a belly area of said containers in said container cluster.

4. The method of claim 1, wherein arranging a band around a container cluster comprises arranging the band in a form-fitting manner on said container cluster.

5. The method of claim 1, further comprising feeding a strip of sequential bands, wherein said sequential bands in said strip have ends that are connected to ends of adjacent bands, and wherein said ends overlap ends of adjacent bands.

6. The method of claim 1, further comprising securing said band to corner containers of said container cluster.

7. The method of claim 6, wherein securing said band comprises applying adhesive material to said corner containers.

8. The method of claim 1, further comprising applying shrink film around said container cluster and said band, and feeding said container cluster, shrink film, and band together into a shrink device for shrinking said shrink film onto said container cluster.

9. The method of claim 8, further comprising, prior to feeding said container cluster, shrink film, and band together into said shrink device, gluing said shrink film onto end faces of said container cluster.

10. The method of claim 1, further comprising fitting said container cluster with a carrying element.

11. A manufacture comprising a cluster pack, said cluster pack comprising containers, shrink film, and a band, wherein said band and said shrink film encircle all of said containers, wherein said band is arranged between said shrink film and said containers, and wherein said shrink film is adhered to end faces of said cluster pack by application of adhesive material.

12. The manufacture of claim 11, wherein said shrink film is glued on said band.

13. The manufacture of claim 11, wherein said band comprises a designated tear point on at least one end face of said cluster pack.

* * * * *